US007483652B2

(12) United States Patent
Higaki

(10) Patent No.: US 7,483,652 B2
(45) Date of Patent: Jan. 27, 2009

(54) IMAGE FORMING APPARATUS AND CHARGING METHOD HAVING GAP HOLDING MEMBERS

(75) Inventor: Toshimasa Higaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 241 days.

(21) Appl. No.: 11/293,542

(22) Filed: Dec. 2, 2005

(65) Prior Publication Data

US 2006/0120759 A1 Jun. 8, 2006

(30) Foreign Application Priority Data

Dec. 2, 2004 (JP) ..... 2004-349478

(51) Int. Cl.
*G03G 15/02* (2006.01)

(52) U.S. Cl. ..... 399/176

(58) Field of Classification Search ..... 399/176, 399/279, 313, 357

See application file for complete search history.

(56) References Cited

U.S. PATENT DOCUMENTS 4,165,173 A * 8/1979 Iwai et al.
4,862,214 A * 8/1989 Kasahara et al.
5,119,137 A * 6/1992 Katagata
5,666,596 A * 9/1997 Yoo
5,799,232 A * 8/1998 Tompkins et al.
2002/0051654 A1* 5/2002 Niimi et al. ..... 399/176
2002/0106224 A1* 8/2002 Yamauchi et al. ..... 399/313
2003/0180071 A1* 9/2003 Suda ..... 399/176
2006/0078353 A1* 4/2006 Kosuge et al. ..... 399/176
2006/0099005 A1* 5/2006 Kitazawa et al. ..... 399/176

FOREIGN PATENT DOCUMENTS

JP 02156278 A * 6/1990
JP 2001-350321 A 12/2001
JP 2002049215 A * 2/2002

* cited by examiner

*Primary Examiner*—Susan S Lee
(74) *Attorney, Agent, or Firm*—Panitch Schwarze Belisario & Nadel LLP

(57) ABSTRACT

An image forming apparatus has: a photosensitive drum as an image holding body to form an electrostatic image; a charging roller which is arranged so as to face the drum and charges it; pressing springs which apply a pressing force to the charging roller toward the drum; and spacer members as gap holding members which are attached to both sides of the charging roller, are come into contact with the drum surface, and hold a gap between the drum and the charging roller. The pressing force of the springs and a frictional coefficient between the drum and the spacer members are set in order to driven-rotate the charging roller to the drum at the same peripheral velocity by a frictional force occurring between the drum and the spacer members. The apparatus uses a contactless charging system for realizing high charging performance, high picture quality, and high durability.

16 Claims, 7 Drawing Sheets

FIG. 5

| FRICTIONAL COEFFICIENT OF SPACER MEMBER | PRESSING FORCE OF SPRING (ONE SIDE) [gf] | DISCRIMINATION ABOUT OK/NG | | FRICTIONAL FORCE PER UNIT LENGTH [gf/mm] |
|---|---|---|---|---|
| | | SLIP | SCRATCH OF PHOTOSENSITIVE DRUM | |
| 0.2 | 150 | × | ○ | 4 |
| | 300 | △ | ○ | 7 |
| | 450 | ○ | ○ | 10 |
| | 600 | ○ | ○ | 13 |
| | 900 | ○ | ○ | 19 |
| 0.3 | 150 | × | ○ | 5 |
| | 300 | ○ | ○ | 10 |
| | 450 | ○ | ○ | 14 |
| | 600 | ○ | ○ | 19 |
| | 900 | ○ | △ | 28 |
| 0.4 | 150 | × | ○ | 7 |
| | 300 | ○ | ○ | 13 |
| | 450 | ○ | ○ | 19 |
| | 600 | ○ | ○ | 25 |
| | 900 | ○ | × | 37 |

IMAGE FORMING APPARATUS AND CHARGING METHOD HAVING GAP HOLDING MEMBERS

BACKGROUND OF THE INVENTION

1. Field of the Invention

The invention relates to a charging method of charging a holding body of an electrostatic image by a charging member arranged in a contactless manner and an image forming apparatus in which charging is executed by such a charging method.

2. Related Background Art

Among conventional image forming apparatuses, there is an image forming apparatus using a contactless charging system in which a charging roller as a charging member is arranged near the surface of a photosensitive drum as an image holding body and a voltage is applied between the charging roller and the photosensitive drum, thereby charging the surface of the photosensitive drum. According to the contactless charging system, the charging roller and the photosensitive drum have to be rotated at a same peripheral velocity while keeping a gap between the charging roller and the photosensitive drum to a small constant value.

FIG. 9 is a schematic diagram of a contactless charging apparatus disclosed in JP-A-2001-350321. According to such a charging apparatus, a gap between a charging roller 1 and a photosensitive drum 2 arranged in a contactless manner is formed by spacer members 3. That is, according to the charging roller 1, a resistive layer 1*a* is provided around the outer circumferential surface of a core 1*b* and the spacer members 3 are wound in the circumferential direction to both edge portions in the axial direction of the resistive layer 1*a*. The spacer member 3 is an adhesive sheet having a thickness of 20 to 200 μm made of polyester, polyethylene terephthalate, or the like in which one surface is formed on an adhesive surface. The spacer member 3 is wrapped while setting the adhesive surface to the inside.

Bearings 24 are attached to both edge portions of the core 1*b* of the charging roller 1. Springs 23 press the charging roller 1 onto the photosensitive drum 2 side through the bearings 24 by a predetermined pressing force. Thus, the spacer members 3 are come into contact with the surface of the photosensitive drum 2 and keep the gap between the charging roller 1 and the photosensitive drum 2 constant.

A photosensitive drum driving gear 22 to drive the photosensitive drum 2 is attached to one end of the photosensitive drum 2 and driven and rotated by a driving motor (not shown). A charging roller driving gear 21 to drive the charging roller 1 is fixed to one end of the core 1*b* of the charging roller 1 and driven and rotated by the photosensitive drum driving gear 22. Thus, the charging roller 1 and the photosensitive drum 2 obtain the rotation of the same peripheral velocity.

However, there is such a problem that in the case of rotating the charging roller 1 by the charging roller driving gear 21, the charging roller 1 is vibrated, so that the gap between the charging roller 1 and the photosensitive drum 2 is not stabilized and a charging spot occurs on the photosensitive drum 2.

SUMMARY OF THE INVENTION

It is, therefore, an object of the invention to solve the problem of the prior art and provide an image forming apparatus and a charging method using the contactless charging system in which high charging performance is maintained and high picture quality and high durability are realized.

According to the present invention, there is provided an image forming apparatus having an image holding body which forms an electrostatic image and at least one of a transfer unit, a developing unit, a charging unit, and a cleaning unit which are arranged so as to face the image holding body, comprising:

a pressing unit which applies a pressing force to the at least one unit toward the image holding body; and gap holding members which are attached to both sides of the at least one unit, are come into contact with a surface of the image holding body, and hold a gap between the at least one unit and the image holding body, wherein the at least one unit is driven and rotated to the image holding body by a frictional force occurring between the image holding body and the gap holding members.

In the image forming apparatus, the gap holding members are wound around both edge circumferential surfaces of the at least one unit and fixed.

Moreover, in the image forming apparatus, the frictional force per unit length in the axial direction of the at least one unit occurring between the image holding body and the gap holding members lies within a range from 10 gf/mm or more to 25 gf/mm or less.

Moreover, in the image forming apparatus, the gap holding member comprises a first layer which is wound around the at least one unit and a second layer which is wound around an outer circumferential surface of the first layer and is come into contact with the image holding body, and a width dimension of the first layer in the axial direction of the at least one unit is larger than a width dimension of the second layer in the axial direction of the at least one unit.

Moreover, in the image forming apparatus, a volume specific resistance value of the first layer of the gap holding member is equal to $10^{10}$ Ω·cm or more and a thickness of each of the first layer and the second layer is equal to 10 μm or more.

Moreover, in the image forming apparatus, the frictional force per unit length in the axial direction of the at least one unit occurring between the image holding body and the gap holding member is equal to 10 gf/mm or more.

Moreover, in the image forming apparatus, the frictional force per unit length in the axial direction of the at least one unit is equal to 37 gf/mm or less.

Moreover, in the image forming apparatus, the charging unit is a charging roller, the image holding body is a photosensitive drum, the transfer unit is a transfer roller, the developing unit is a developing roller, and the cleaning unit is a cleaning roller.

Further, according to the present invention, there is provided a charging method of pressing gap holding members attached to both ends of a charging member onto a circumferential surface of an image holding body through pressing means, holding a gap between the charging member and the image holding body, and allowing the charging member to charge the image holding body, comprising the steps of:

setting a pressing force of the pressing means and a frictional coefficient between the image holding body and the gap holding members to predetermined values; and driven-rotating the charging member by a frictional force occurring between the image holding body and the gap holding members, thereby charging the image holding body.

Further, according to the present invention, there is also provided an image forming apparatus having an image holding body which forms an electrostatic image and at least one of a transfer unit, a developing unit, a charging unit, and a cleaning unit which are arranged so as to face the image holding body, comprising:

a pressing unit which applies a pressing force to the at least one unit toward the image holding body; and gap holding members which are attached to both sides of the image holding body, are come into contact with a surface of the at least one unit, and hold a gap between the at least one unit and the image holding body, wherein the at least one unit is driven and rotated to the image holding body by a frictional force occurring between the at least one unit and the gap holding members.

In the image forming apparatus, the gap holding members are wound around both edge circumferential surfaces of the image holding body and fixed.

Moreover, in the image forming apparatus, the frictional force per unit length in the axial direction of the at least one unit occurring between the at least one unit and the gap holding members lies within a range from 10 gf/mm or more to 25 gf/mm or less.

Moreover, in the image forming apparatus, the gap holding member comprises a first layer which is wound around the image holding body and a second layer which is wound around an outer circumferential surface of the first layer and is come into contact with the at least one unit, and a width dimension of the first layer in the axial direction of the at least one unit is larger than a width dimension of the second layer in the axial direction of the at least one unit.

Moreover, in the image forming apparatus, a volume specific resistance value of the first layer of the gap holding member is equal to $10^{10}$ Ω·cm or more and a thickness of each of the first layer and the second layer is equal to 10 μm or more.

Moreover, in the image forming apparatus, the frictional force per unit length in the axial direction of the at least one unit occurring between the at least one unit and the gap holding member is equal to 10 gf/mm or more.

Moreover, in the image forming apparatus, the frictional force per unit length in the axial direction of the at least one unit is equal to 37 gf/mm or less.

Moreover, in the image forming apparatus, the charging unit is a charging roller, the image holding body is a photosensitive drum, the transfer unit is a transfer roller, the developing unit is a developing roller, and the cleaning unit is a cleaning roller.

According to the present invention, there is also provided a charging method of pressing gap holding members attached to both ends of an image holding body onto a circumferential surface of a charging member through pressing means, holding a gap between the charging member and the image holding body, and allowing the charging member to charge the image holding body, comprising the steps of:

setting a pressing force of the pressing means and a frictional coefficient between the charging member and the gap holding members to predetermined values; and driven-rotating the charging member by a frictional force occurring between the charging member and the gap holding members, thereby charging the image holding body.

According to the image forming apparatus of the invention, since the charging member is rotated by the frictional force occurring between the image holding body and the gap holding member without providing driving gears for the charging member, the vibration of the charging member which is caused by the gear driving is eliminated and the stable charging can be performed.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 5 is a diagram showing a result of continuous print tests;

DETAILED DESCRIPTION OF THE PREFERRED EMBODIMENTS

An embodiment of the invention will be described in detail hereinbelow with reference to the drawings.

Embodiment 1

First, a fundamental construction of an image forming apparatus according to the invention will be explained.

Figure 2:
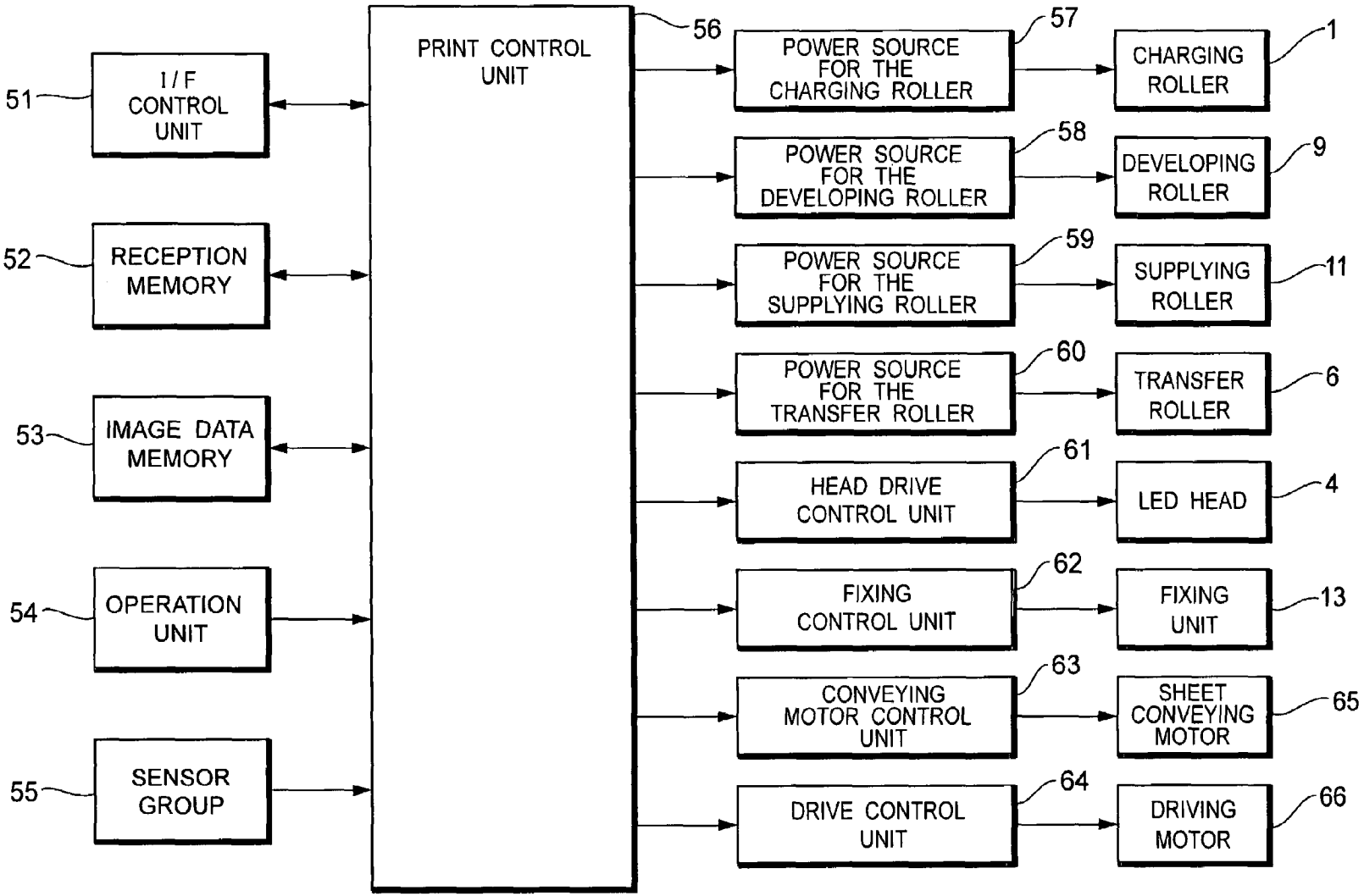
FIG. 2 is a block diagram showing a construction of the image forming apparatus of the invention.

FIG. 2 is a block diagram showing a construction of the image forming apparatus according to the invention. A print control unit 56 is constructed by a microprocessor, a ROM, a RAM, input/output (I/O) ports, a timer, and the like. The print control unit 56 receives print data and a control command from an upper apparatus (not shown) through an interface (I/F) control unit 51, controls a sequence of the whole image forming apparatus, and executes the printing operation.

A reception memory 52 temporarily stores the print data inputted from the upper apparatus through the I/F control unit 51. The print data stored in the reception memory 52 is edited by the print control unit 56 and stored as image data into an image data memory 53.

An operation unit 54 has: an LED for displaying a state of the image forming apparatus; a switch for giving an instruction from the operator to the image forming apparatus; and the like. A group of sensors 55 include the following various sensors for monitoring the operating mode of the image forming apparatus: for example, a sheet position detecting sensor; a temperature/humidity sensor; a concentration sensor; and the like.

A power source 57 for the charging roller applies a predetermined voltage to the charging roller 1 in order to charge the surface of the photosensitive drum 2 under control of the print control unit 56. A power source 58 for a developing roller applies a predetermined voltage to a developing roller 9 in order to deposit toner 8 (refer to FIG. 3) onto an electrostatic latent image on the surface of the photosensitive drum 2. A power source 59 for a supplying roller applies a predetermined voltage to a toner supplying roller 11 in order to supply the toner 8 to the developing roller 9. A power source 60 for a transfer roller applies a predetermined voltage to a transfer roller 6 in order to transfer a toner image formed on the surface of the photosensitive drum 2 onto a recording medium 12 (refer to FIG. 3). The applying voltages from the charging roller power source 57, developing roller power source 58, and supplying roller power source 59 can be changed under control of the print control unit 56, respectively.

A head drive control unit 61 transmits the image data stored in the image data memory 53 to an LED head 4 and drives the LED head 4.

A fixing control unit 62 applies a voltage to a fixing unit 13 in order to fix the toner image transferred onto the recording medium 12. The fixing unit 13 has: a heater to fuse the toner constructing the toner image on the recording medium 12; a temperature sensor to detect a temperature; and the like. The fixing control unit 62 reads a sensor output of the temperature sensor, energizes the heater on the basis of the sensor output, and makes control so that the fixing unit 13 is held at a predetermined temperature.

A conveying motor control unit 63 controls a sheet conveying motor 65 to convey the recording medium 12. The recording medium 12 is conveyed or stopped at predetermined timing by the control of the print control unit 56. A drive control unit 64 drives a driving motor 66 to rotate the photosensitive drum 2.

Figure 3:
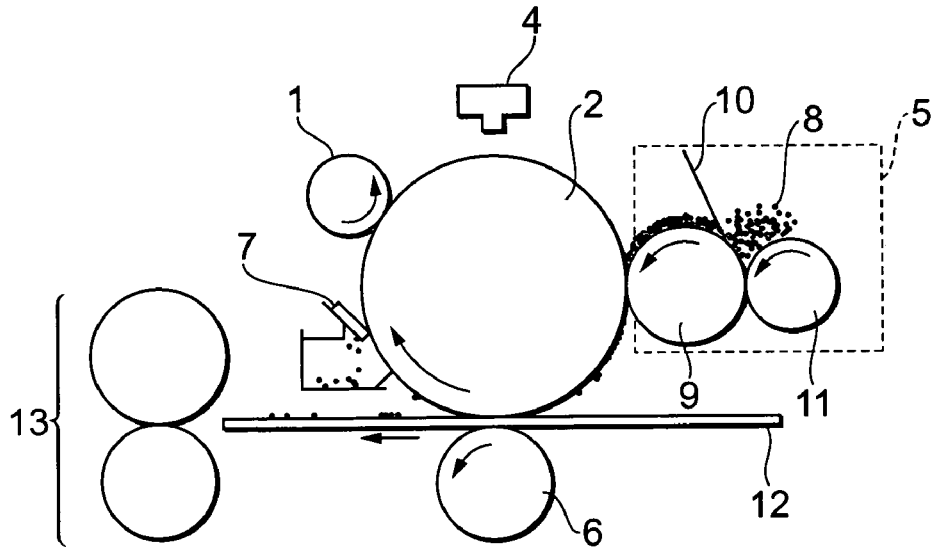
FIG. 3 is a schematic diagram showing a construction of a main section of the image forming apparatus according to the invention.

FIG. 3 is a schematic diagram showing a construction of a main section of the image forming apparatus according to the invention. The image forming apparatus has a rotary drum type photosensitive drum 2 as an image holding body constructed in such a manner that the electrostatic latent image is formed on the surface and the toner image is formed by developing the electrostatic latent image. The photosensitive drum 2 is constructed by forming a film made of a photoconductive material onto the surface of a conductive raw pipe.

The following component elements are arranged around the photosensitive drum 2 in order in the rotating direction of the photosensitive drum 2: the charging roller 1 to charge the surface of the photosensitive drum 2; the LED head 4 to form the electrostatic latent image by the charging charges by irradiating light onto the charged surface of the photosensitive drum 2 and exposing it; a developing unit 5 to form the toner image by depositing the toner onto the electrostatic latent image on the surface of the photosensitive drum 2; the transfer roller 6 to transfer the toner image on the surface of the photosensitive drum 2 onto the recording medium 12; and a cleaning blade 7 to scrape off the toner 8 remaining on the surface of the photosensitive drum 2 without being transferred.

The developing unit 5 has: the developing roller 9 to form the toner image by depositing the toner 8 onto the electrostatic latent image on the surface of the photosensitive drum 2; a developing blade 10 serving as a toner layer thickness suppressing member to form a layer of the toner 8 onto the surface of the developing roller 9; and the toner supplying roller 11 to supply the toner 8 to the developing roller 9.

Figure 1:
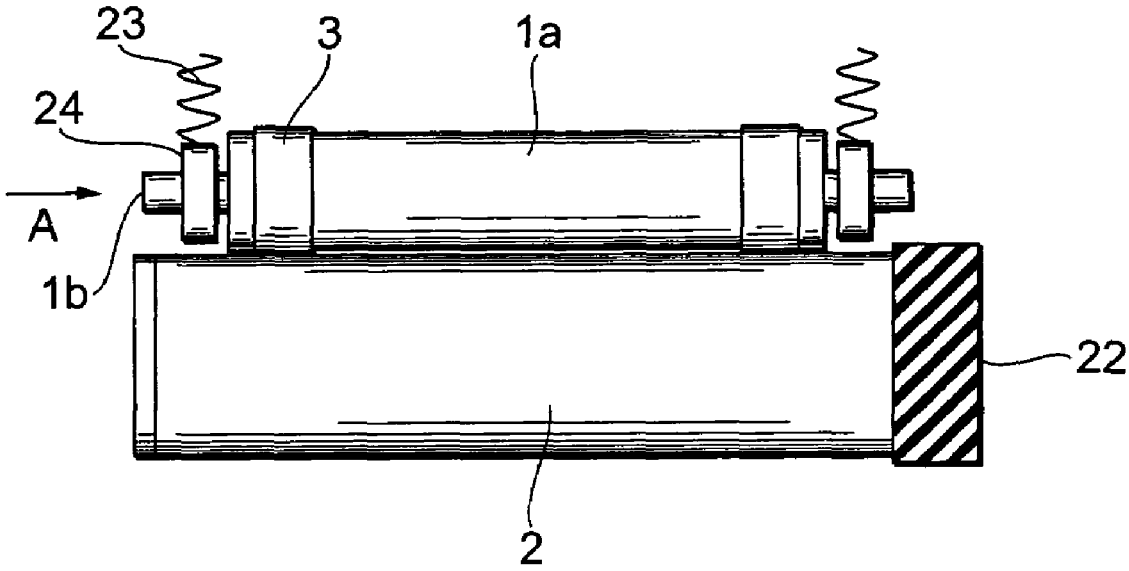
FIG. 1 is a schematic diagram of a charging roller and a photosensitive drum equipped for an image forming apparatus of the embodiment 1 according to the invention.
Figure 4:
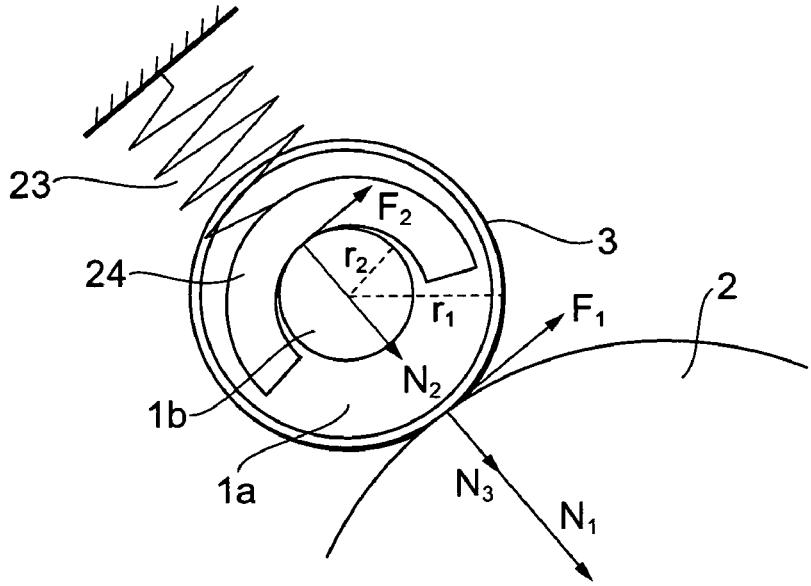
FIG. 4 is a side elevational view of the charging roller and the photosensitive drum of the embodiment 1.

The construction of the main section of the image forming apparatus of the embodiment 1 will now be described. FIG. 1 is a schematic diagram of the charging roller 1 and the photosensitive drum 2 equipped for the image forming apparatus of the embodiment 1. FIG. 4 is a side elevational view of the charging roller 1 and the photosensitive drum 2 when seen from the direction shown by an arrow A in FIG. 1.

The charging roller 1 has: the conductive core 1*b* formed in a columnar shape; and the resistive layer 1*a* formed around the outer circumferential surface of the core 1*b* excluding both of its edge portions. For example, a metal axis obtained by plating an SUS with nickel is used as a core 1*b*. The resistive layer 1*a* is made of epichlorohydrine rubber and formed by an elastic layer whose volume specific resistance value lies within a range of $10^3$ to $10^9$ Ω·cm and whose rubber hardness is equal to about 60 degree when measured by a durometer A.

In the charging roller 1, the spacer members 3 are wound in the circumferential direction around both edge portions in the axial direction of the resistive layer 1*a* and the bearings 24 are attached to both edge portions of the core 1*b*. One end of each of a pair of springs 23 presses the charging roller 1 onto the photosensitive drum 2 side through the bearing 24 by the same pressing force with respect to the right and left springs. Thus, the spacer members 3 are come into contact with the surface of the photosensitive drum 2 and keep the gap between the charging roller 1 and the photosensitive drum 2 constant. The other ends of the springs 23 are fixed to a chassis wall surface in which a distance from a center axis of the photosensitive drum 2 is held constant.

In the embodiment, an outer diameter of the photosensitive drum 2 is equal to 30 mm and polycarbonate is contained in the top surface layer. In the charging roller 1, a radius of the core 1*b* is equal to 6.0 mm and a radius of the resistive layer 1*a* is equal to 12.0 mm. A weight of the charging roller 1 is equal to 85 g. The charging roller 1 is located at an angle of elevation of 45° to the photosensitive drum 2. A material of the bearings 24 of the charging roller 1 is polyacetal and a frictional coefficient between the bearing 24 and the core 1*b* is equal to about 0.13. A thickness of each spacer member 3 is equal to 50 μm, a width dimension in the axial direction of the charging roller 1 is equal to 10 mm, and the same spacer member is used with respect to the right and left spacer members 3. A material of the spacer member 3 is PET and a frictional coefficient is changed by changing the surface state.

A photosensitive drum driving gear 22 to drive the photosensitive drum 2 is attached to one end of the photosensitive drum 2 and driven and rotated by the driving motor 66. No driving gears are provided for the charging roller 1 and the charging roller 1 is rotated by the frictional force occurring between the spacer members 3 and the photosensitive drum.

An outline of the operation in the image forming apparatus of the invention will now be described. When the drive control unit 64 drives the driving motor 66 by the control of the print control unit 56 shown in FIG. 2, the photosensitive drum 2 is rotated in the direction shown by an arrow in FIG. 3 and the developing roller 9, toner supplying roller 11, and transfer roller 6 are rotated in the directions shown by arrows in FIG. 3, respectively. A rotational speed upon printing of the photosensitive drum 2 is equal to 120 rpm.

When the photosensitive drum 2 is rotated, the charging roller 1 receives the frictional force occurring between the spacer members 3 and the photosensitive drum 2 and is rotated in the direction shown by the arrow in FIG. 3, thereby charging the surface of the photosensitive drum 2. In order to allow the charging roller 1 to obtain the rotation of the same peripheral velocity as that of the photosensitive drum 2, it is necessary to adjust the frictional force so as not to cause a slip between the spacer members 3 and the photosensitive drum 2.

Assuming that a frictional coefficient between the spacer members 3 and the photosensitive drum 2 is set to $\mu_1$, a force which is applied from the charging roller 1 in the radial direction of the cross section of the photosensitive drum 2 is set to $N_1$, and a frictional force which is caused between the spacer members 3 and the photosensitive drum 2 is set to $F_1$, $F_1=\mu_1 N_1$. Similarly, assuming that a frictional coefficient between the bearing 24 and the core 1*b* is set to $\mu_2$ and a pressing force which is applied from the charging roller in the radial direction of the cross section of the photosensitive drum 2 by the spring 23 is set to $N_2$, a frictional force $F_2$ which is caused between the bearing 24 and the core 1*b* is equal to ($F_2=\mu_2 N_2$). Assuming that a force which is applied to the photosensitive drum 2 by a tare weight of the charging roller 1 is set to $N_3$, the force $N_1$ is equal to ($N_1=N_2+N_3$).

When a radius of the circumferential surface of the spacer member 3 is assumed to be $r_1$ and a radius of the core 1*b* is labeled as $r_2$, to rotate the charging roller 1, the following condition has to be satisfied.

$$F_1 r_1 > F_2 r_2$$

That is, the following condition has to be satisfied.

$$\mu_1 > \mu_2 (r_2/r_1) N_2/(N_2+N_3)$$

When the radius $r_1$ of the spacer member 3 is equal to 12.0 mm, the radius $r_2$ of the core 1*b* is equal to 6.0 mm, and the frictional coefficient $\mu_2$ of the friction between the bearing 24 and the core 1*b* is equal to 0.13, if axes of the charging roller 1 and the photosensitive drum 2 are horizontal and the rotational speed of the photosensitive drum 2 is equal to or less than 200 rpm, the charging roller 1 is rotated so long as the frictional coefficient $\mu_1$ is larger than 0.065.

Actually, since the toner 8 is deposited onto the spacer members 3 by repeating the printing, a slip is liable to occur between the spacer members 3 and the photosensitive drum 2. There is also a case where the spacer member 3 damages the surface of the photosensitive drum 2 and the damage (scratch) becomes deep, so that a leak current is generated. In the case of a defective printing which is caused by the slip when a halftone image is printed, a lateral stripe whose concentration is high and whose width is large appears upon slipping. In a defective printing which is caused by the leak current, a lateral stripe whose concentration is high appears every rotating period of the photosensitive drum.

Evaluation is made by using the spacer members 3 having different frictional coefficients and the springs 23 which apply different pressing forces. As an evaluating method, the continuous printing is executed, the printing is executed until the photosensitive drum 2 has rotated 100 thousand times, and print images are confirmed. A halftone image of a concentration of 30% is used for the print images.

The frictional coefficient of the spacer member 3 is varied by changing the surface state. In this instance, three kinds of spacer members 3 whose frictional coefficients to the surface of the photosensitive drum 2 are equal to about 0.2, 0.3, and 0.4 are used. Five kinds of springs 23 in which the pressing forces of one side have been set to 150 gf, 300 gf, 450 gf, 600 gf, and 900 gf are used and the same pressing force is applied to both ends of the charging roller 1.

Figure 6:
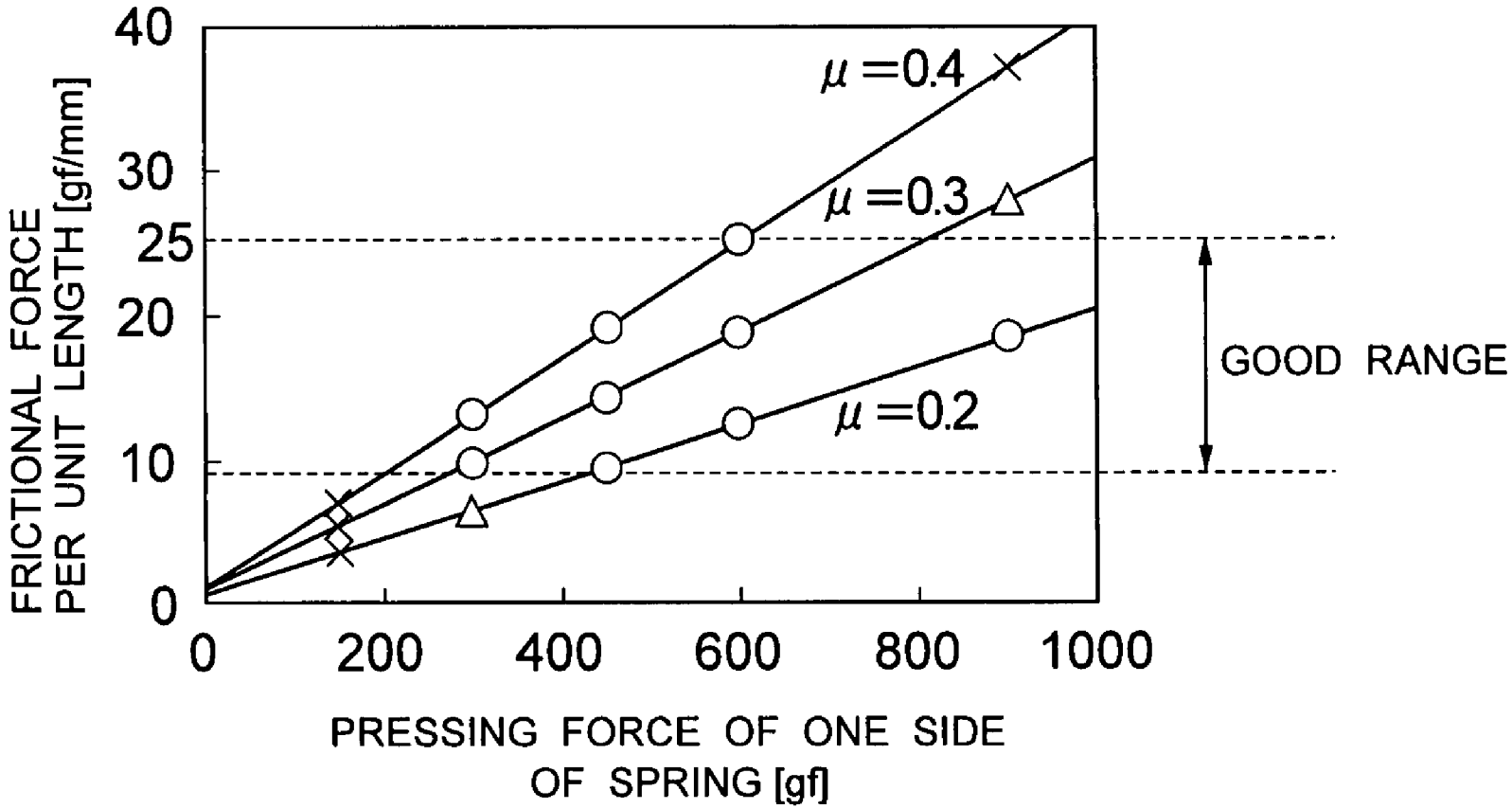
FIG. 6 is a diagram showing a change in unit length frictional force when a one-sided weight of a spring is changed.

Discrimination results about OK/NG by the evaluation are shown in FIG. 5. Distribution of the discrimination results is shown in FIG. 6. As a result of the continuous print test, the spacer members in which a problem has occurred until the photosensitive drum 2 has rotated 50 thousand times are shown by "x", the spacer members in which a problem has occurred until the photosensitive drum 2 has rotated within a range of 50 to 100 thousand times are shown by "Δ", and the spacer members in which no problems occur until the photosensitive drum 2 has rotated 100 thousand times are shown by "○". FIG. 5 also shows the frictional force per unit length in the axial direction of the charging roller 1 which is caused between the spacer members 3 and the photosensitive drum 2 and obtained from the frictional coefficients and the pressing forces of the springs 23.

It will be understood from FIGS. 5 and 6 that a boundary at which the slip occurs lies within a range of 7 to 10 gf/mm and a boundary at which the leak current due to the damage of the photosensitive drum 2 is generated lies within a range of 25 to 28 gf/mm. Therefore, if the frictional force per unit length in the axial direction of the charging roller 1 which is caused between the spacer members 3 and the photosensitive drum 2 is set to a value in a range from 10 gf/mm or more to 25 gf/mm or less, no slips occur between the charging roller 1 and the photosensitive drum 2 and the charging abnormality due to the abrasion of the photosensitive drum 2 does not occur.

According to the image forming apparatus of the embodiment 1, by rotating the charging roller 1 by the frictional force which is caused between the spacer members 3 and the photosensitive drum 2 without providing the driving gear for the charging roller 1, the vibration of the charging roller 1 which is caused by the gear driving is eliminated, so that the stable charging can be performed. If the frictional force per unit length in the axial direction of the charging roller 1 which is caused between the spacer members 3 and the photosensitive drum 2 is set to a value in a range of 10 to 25 gf/mm, no slips occur between the charging roller 1 and the photosensitive drum 2, the charging abnormality due to the abrasion of the photosensitive drum 2 does not occur, high charging performance can be maintained, and high picture quality can be realized.

Since there is no need to attach the driving gear to the charging roller 1, a D-cut and a knurlizer become unnecessary and the costs can be reduced.

Figure 10:
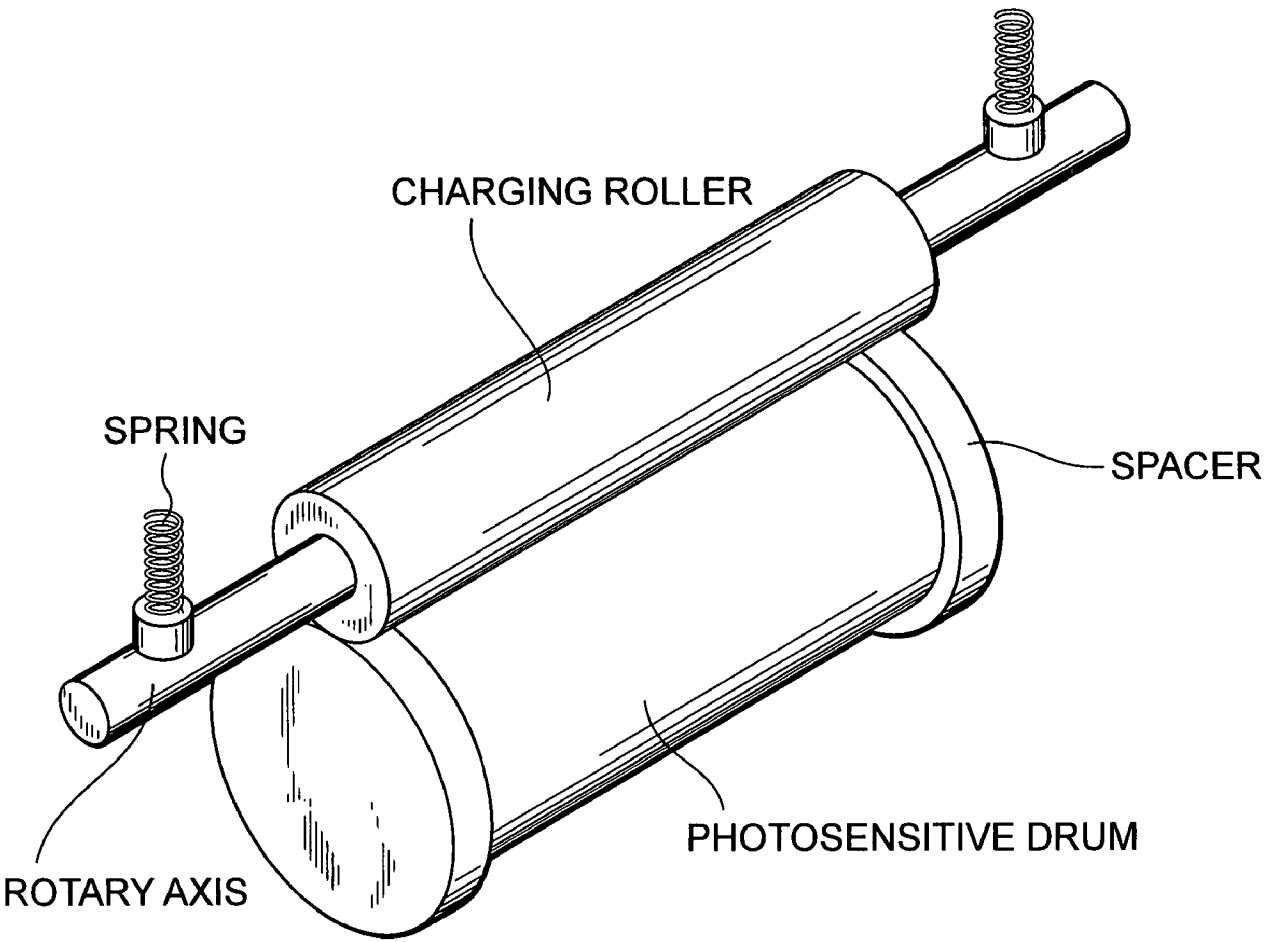
FIG. 10 is a cubic diagram showing a main part in other embodiment of the present invention.

As another example of the embodiment 1, the spacer members may be provided on the photosensitive member side as shown in FIG. 10. When experiments to the structure as shown in FIG. 10 are executed by using the evaluating method in the embodiment 1, results similar to those shown in FIGS. 5 and 6 are obtained.

Embodiment 2

The embodiment 2 differs from the embodiment 1 with respect to a structure in which each spacer member 3 which holds the gap between the charging roller 1 and the photosensitive drum 2 is constructed by two layers.

Figure 7:
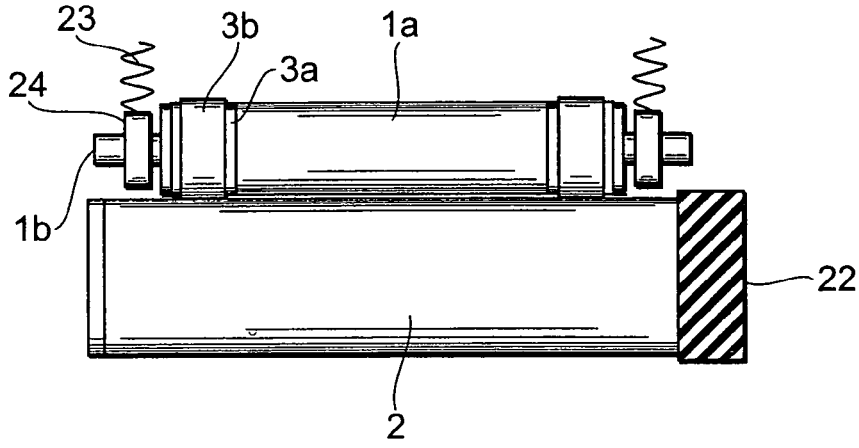
FIG. 7 is a schematic diagram of a charging roller and a photosensitive drum equipped for an image forming apparatus of the embodiment 2.
Figure 8:
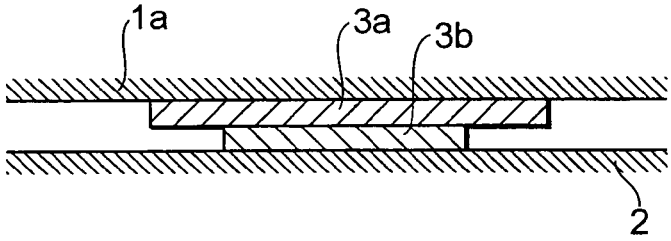
FIG. 8 is a schematic cross sectional view of a spacer member which the charging roller of the embodiment 2 has.
Figure 9:
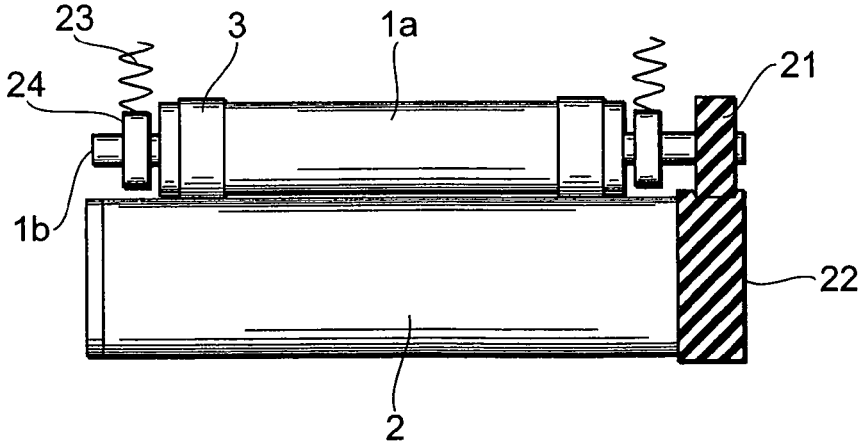
FIG.9 PRIOR ART
FIG. 9 is a schematic diagram showing an example of a charging roller and a photosensitive drum equipped for a conventional image forming apparatus.

FIG. 7 is a schematic diagram of the charging roller 1 and the photosensitive drum 2 equipped for an image forming apparatus of the embodiment 2. FIG. 8 is a cross sectional view of a contact portion of the charging roller 1 and the photosensitive drum 2 in FIG. 7. The spacer member 3 has: a first layer 3*a* which is wound around the resistive layer 1*a* of the charging roller 1; and a second layer 3*b* which is wound around the first layer 3*a* and is come into contact with the photosensitive drum 2.

The first layer 3*a* and the second layer 3*b* of the spacer member 3 may be made of the same material or different materials. The first layer 3*a* has a volume specific resistance value of $10^{10}$ Ω·cm or more and the second layer 3*b* may be either conductive or insulative. Each of the first layer 3*a* and the second layer 3*b* has a thickness of 10 μm or more and the sum of the thicknesses of both layers is equal to or less than 200 μm. A frictional coefficient between the second layer 3*b* and the photosensitive drum 2 is larger than that between the bearing 24 and the core 1*b* of the charging roller 1. In the axial direction of the charging roller 1, a width dimension of the contact portion of the first layer 3*a* and the charging roller 1 is larger than that of the contact portion of the second layer 3*b* and the photosensitive drum 2.

By repetitively executing the printing, the second layer 3*b* of the spacer member 3 damages the surface of the photosensitive drum 2. However, in the embodiment 2, since the first layer 3*a* of the spacer member 3 is a high resistance layer whose volume specific resistance value is equal to or larger than $10^{10}$ Ω·cm or more, the leak current which penetrates the spacer member 3 is not generated. Since the width dimension of the first layer 3*a* in the axial direction of the charging roller 1 is larger than that of the second layer 3*b*, in the case where the damage of the surface of the photosensitive drum 2 is increased or a scratch is caused on the photosensitive drum 2 in the edge portion of the second layer 3*b*, the leak current can be prevented. Since the problem which is caused by the abrasion of the photosensitive drum 2 is eliminated, even if the frictional force occurring between the photosensitive drum 2 and the second layer 3*b* of the spacer member 3 is large, there is no problem and it is not always necessary to set the upper limit of the frictional force.

The first layer 3*a* of the spacer member 3 is constructed as a high resistance layer whose volume specific resistance value is equal to $10^{10}$ Ω·cm and a continuous print test similar to that in the embodiment 1 is executed. Thus, the leak current due to the damage of the photosensitive drum 2 is not generated in both the case where the frictional coefficient of the spacer member 3 shown in FIG. 5 is equal to 0.3 and the frictional force of the unit length is equal to 28 gf/mm and the case where the frictional coefficient is equal to 0.4 and the frictional force of the unit length is equal to 37 gf/mm. Therefore, no leak current is generated when the frictional force of the unit length lies within a range from 10 gf/mm or more to 37 gf/mm.

According to the image forming apparatus of the embodiment 2, the spacer member 3 is constructed by the two layers, the first layer 3*a* which is wound around the charging roller 1 is set to the high resistance layer, and the width dimension of the first layer 3*a* in the axial direction of the charging roller 1 is set to be larger than that of the second layer 3*b* which is come into contact with the photosensitive drum 2. Therefore, even if the damage is caused on the surface of the photosensitive drum 2 by the friction between the spacer members 3 and the photosensitive drum 2, the generation of the leak current can be prevented and the frictional force occurring between the photosensitive drum 2 and the spacer members 3 can be increased. High durability of the photosensitive drum 2 can be realized.

As another example of the embodiment 2, in the structure in which the spacer members are provided on the photosensitive member side as shown in FIG. 10, it is also possible to use a structure in which each spacer member which holds the gap between the charging roller and the photosensitive drum is constructed by two layers. When experiments are executed to the structure by using the evaluating method in the embodiment, results similar to those mentioned above are obtained.

Although the above embodiments have been described with respect to the case of using the photosensitive drum and the charging roller as an example, in an image forming apparatus having at least one of the transfer roller, developing roller, and cleaning roller which are arranged so as to face the photosensitive drum, the invention may be applied to the photosensitive drum and at least one of the transfer roller, developing roller, and cleaning roller by using the method of the embodiment mentioned above.

The present invention is not limited to the foregoing embodiments but many modifications and variations are possible within the spirit and scope of the appended claims of the invention.

What is claimed is:

1. An image forming apparatus having an image holding body which forms an electrostatic image and at least one of a transfer unit, a developing unit, a charging unit, and a cleaning unit which are arranged so as to face said image holding body, comprising:

a pressing unit which applies a pressing force to said at least one unit toward said image holding body; and a gap holding member which is attached to said at least one unit, said gap holding member contacting a surface of said image holding body and holding a gap between said at least one unit and said image holding body, wherein said at least one unit is driven and rotated to said image holding body by a frictional force occurring between said image holding body and said gap holding member, and the frictional force per unit length in the axial direction of said at least one unit occurring between said image holding body and said gap holding member lies within a range from 10 gf/mm or more to 25 gf/mm or less.

2. The image forming apparatus according to claim 1, wherein said gap holding member has two spacer members, the spacer member are attached to both sides of said at least one unit and are fixedly wound around both edge circumferential surfaces of said at least one unit.

3. An image forming apparatus having an image holding body which forms an electrostatic image and at least one of a transfer unit, a developing unit, a charging unit, and a cleaning unit which are arranged so as to face said image holding body, comprising:

a pressing unit which applies a pressing force to said at least one unit toward said image holding body; and a gap holding member which is attached to said at least one unit, said gap holding member contacting a surface of said image holding body and holding a gap between said at least one unit and said image holding body, wherein said at least one unit is driven and rotated to said image holding body by a frictional force occurring between said image holding body and said gap holding member and wherein said gap holding member comprises:

a first layer which is wound around said at least one unit; and a second layer which is wound around an outer circumferential surface of said first layer and contacts said image holding body, and a width dimension of said first layer in the axial direction of said at least one unit is larger than a width dimension of said second layer in the axial direction of said at least one unit.

4. The image forming apparatus according to claim 3, wherein a volume specific resistance value of said first layer of said gap holding member is equal to $10^{10}$ Ω·cm or more and a thickness of each of said first layer and said second layer is equal to 10 μm or more.

5. The image forming apparatus according to claim 4, wherein the frictional force per unit length in the axial direction of said at least one unit occurring between said image holding body and said gap holding member is equal to 10 gf/mm or more.

6. The image forming apparatus according to claim 5, wherein the frictional force per unit length in the axial direction of said at least one unit is equal to 37 gf/mm or less.

7. The image forming apparatus according to claim 3, wherein said gap holding member has two spacer members, the spacer member are attached to both sides of said at least one unit and are fixedly wound around both edge circumferential surfaces of said at least one unit.

8. An image forming apparatus having an image holding body which forms an electrostatic image and at least one of a transfer unit, a developing unit, a charging unit, and a cleaning unit which are arranged so as to face said image holding body, comprising:

a pressing unit which applies a pressing force to said at least one unit toward said image holding body; and a gap holding member attached to said image holding body, the gap holding member contacting a surface of said at least one unit, and holding a gap between said at least one unit and said image holding body, wherein said at least one unit is driven and rotated to said image holding body by a frictional force occurring between said at least one unit and said gap holding member, and the frictional force per unit length in the axial direction of said at least one unit occurring between said at least one unit and said gap holding member lies within a range from 10 gf/mm or more to 25 gf/mm or less.

9. The image forming apparatus according to claim 8, wherein said gap holding member has two spacer members, the spacer members are attached to both sides of said at least one unit and are fixedly wound around both edge circumferential surfaces of said at least one unit.

10. The image forming apparatus according to claim 8, wherein said charging unit is a charging roller, said image holding body is a photosensitive drum, said transfer unit is a transfer roller, said developing unit is a developing roller, and said cleaning unit is a cleaning roller.

11. An image forming apparatus having an image holding body which forms an electrostatic image and at least one of a transfer unit, a developing unit, a charging unit, and a cleaning unit which are arranged so as to face said image holding body, comprising:

a pressing unit which applies a pressing force to said at least one unit toward said image holding body; and a gap holding member attached to said image holding body, the gap holding member contacting with a surface of said at least one unit, and holding a gap between said at least one unit and said image holding body, wherein said at least one unit is driven and rotated to said image holding body by a frictional force occurring between said at least one unit and said gap holding member, and wherein said gap holding member comprises:

a first layer which is wound around said image holding body; and a second layer which is wound around an outer circumferential surface of said first layer and contacts with said at least one unit, and a width dimension of said first layer in the axial direction of said at least one unit is larger than a width dimension of said second layer in the axial direction of said at least one unit.

12. The image forming apparatus according to claim 11, wherein said gap holding member has two spacer members, the spacer members are attached to both sides of said at least one unit and are fixedly wound around both edge circumferential surfaces of said at least one unit.

13. The image forming apparatus according to claim 12, wherein a volume specific resistance value of said first layer of said gap holding member is equal to $10^{10}$ Ω·cm or more and a thickness of each of said first layer and said second layer is equal to 10 μm or more.

14. The image forming apparatus according to claim 13, wherein the frictional force per unit length in the axial direction of said at least one unit occurring between said at least one unit and said gap holding member is equal to 10 gf/mm or more.

15. The image forming apparatus according to claim 14, wherein the frictional force per unit length in the axial direction of said at least one unit is equal to 37 gf/mm or less.

16. A charging method of pressing a gap holding member attached to an image holding body onto a circumferential surface of a charging member through pressing means, holding a gap between said charging member and said image holding body, and allowing said charging member to charge said image holding body, comprising the steps of:

setting a pressing force of said pressing means and a frictional coefficient between said charging member and said gap holding member to predetermined values such that a frictional force per unit length in the axial direction of said charging member occurring between said charging member and said gap holding member lies within a range from 10 gf/mm or more to 25 gf/mm or less; and driven-rotating said charging member by the frictional force occurring between said charging member and said gap holding member, thereby charging said image holding body.

* * * * *